US009755362B1

(12) United States Patent
Musick et al.

(10) Patent No.: US 9,755,362 B1
(45) Date of Patent: Sep. 5, 2017

(54) ELECTRICAL SOCKET OUTLET PLATE HAVING PLUG STABILIZING FEATURES

(71) Applicant: DELPHI TECHNOLOGIES, INC., Troy, MI (US)

(72) Inventors: Steven A. Musick, Burton, OH (US); Don E. Bizon, Boardman, OH (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 15/208,855

(22) Filed: Jul. 13, 2016

(51) Int. Cl.
*H01R 13/631* (2006.01)
*H01R 13/73* (2006.01)

(52) U.S. Cl.
CPC ..... *H01R 13/631* (2013.01); *H01R 13/73* (2013.01)

(58) Field of Classification Search
CPC ..... H01R 13/631; H01R 13/73
USPC ..... 439/536
See application file for complete search history.

(56) References Cited

U.S. PATENT DOCUMENTS 2,438,143 A * 3/1948 Brown ..... H01R 13/72 174/66
3,257,497 A * 6/1966 Marston ..... H01R 13/72 174/135
3,331,915 A * 7/1967 Lucci ..... H01R 13/60 174/66
4,921,444 A * 5/1990 Cama ..... H01R 13/60 439/528
5,299,099 A * 3/1994 Archambault ..... H01R 13/6395 174/51
5,472,355 A * 12/1995 Wittmann ..... H01R 13/6395 439/373
6,966,792 B1 * 11/2005 Willers ..... H01R 13/73 439/373
7,255,588 B2 * 8/2007 Wilder ..... H01R 13/6392 439/373
8,283,802 B2 * 10/2012 Jansma ..... H01R 13/6272 307/23
8,986,040 B2 * 3/2015 Garofalo ..... H01R 13/6395 439/373
9,197,018 B2 * 11/2015 Garofalo ..... H01R 13/6395
2015/0083454 A1 * 3/2015 Michaelis, IV ..... H02G 3/14 174/66

* cited by examiner

*Primary Examiner* — Alexander Gilman
(74) *Attorney, Agent, or Firm* — Robert J. Myers

(57) ABSTRACT

An electrical outlet wall plate includes a plate having an outer surface, an inner surface, and a peripheral edge. The outlet wall plate defines a socket opening configured to receive an electrical outlet socket and defining a fastener opening configured to receive a fastener configured to secure the outlet wall plate to the outlet socket. The outlet wall plate further includes a plug stabilizing feature having an inner wall, an outer wall, and a top wall. The plug stabilizing feature projects from the outer surface of the plate and at least partially surrounding a perimeter of the socket opening. The outlet wall plate limits lateral and vertical movement of the plug terminals in the socket and protects the operator from inadvertent contact with plug terminals the as the plug is inserted into the socket.

10 Claims, 6 Drawing Sheets

ELECTRICAL SOCKET OUTLET PLATE HAVING PLUG STABILIZING FEATURES

TECHNICAL FIELD OF THE INVENTION

The present invention relates generally to electrical socket accessories and, more particularly, to socket cover plates having plug stabilizing features.

BACKGROUND OF THE INVENTION

Electrical plugs, such as those conforming to the National Electrical Manufacturers Association (NEMA) 5-15P or NEMA 6-20P standards, are used to connect electrical devices with electrical sockets, such as those conforming to NEMA 5-15S or NEMA 6-20S standards. There are several issues that may arise in the use of these plug/socket combinations. First, as shown in FIG. 1, an operator's fingers 1 may inadvertently contact the conductive pins 2 of the plug 3 as the plug 3 is inserted into an electrical outlet socket (not shown) surrounded by a flat wall plate 4, posing a risk of electric shock to the operator. Second, as shown in FIG. 2A, an operator 1 may attempt to remove the plug 3 from the socket by grasping the electrical cord 5 attached to the plug 3 and pulling on the cord 5 rather than properly grasping the plug 3. As shown in FIG. 2B, this may cause the plug 3 to rotate in the socket and cause damage to the pins 2 that result in increased electrical resistance and increased pin temperatures in use or could cause pin failure. Similar rotation of the plug 3 in the socket may also be caused by an electrical device 6, such as an electric vehicle battery charger, also known as electric vehicle service equipment (EVSE), hanging from an outlet 7 where the socket 8 is oriented such that the cord exits the top of the plug and then curves outwardly to extend to the EVSE as shown in FIG. 3.

Although this problem of plug rotation may more acutely affect angled plugs 3 having a 90 degree cord 5 to pin 2 relationship as in the plugs shown in FIGS. 2A and 2B, a straight plug 9 having a 180 degree relationship between the pins 2 and the cord 5 as shown in FIG. 4 may also experience rotation in the socket that could damage the plug pins if the cord or plug is pulled or yanked in an upward or downward direction.

Therefore, a needs exists to inhibit damage to plug pins caused by rotation of the plug pins in the socket.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, an electrical outlet wall plate is provided. The outlet wall plate includes a plate having an outer surface, an inner surface, and a peripheral edge defining a socket opening configured to receive an electrical outlet socket and defining a fastener opening configured to receive a fastener configured to secure the outlet wall plate to the outlet socket. The outlet wall plate further includes a plug stabilizing feature having an inner wall, an outer wall, and a top wall, said plug stabilizing feature projecting from the outer surface of the plate and at least partially surrounding a perimeter of the socket opening.

The plug stabilizing feature may completely surround the perimeter of the socket opening. The plug stabilizing feature may be closer to the socket opening than the peripheral edge of the plate. The plug stabilizing feature may defines a slot in the top wall extending from the outer wall to the inner wall. The plug stabilizing feature may define four slots in the top wall extending from the outer wall to the inner wall and arranged in an ninety degree orientation from one another. The slot may have a rounded end or alternatively the slot may have a flat end that extends from the top wall to the outer surface of the plate.

The socket opening may be configured to receive an outlet socket that conforms to National Electrical Manufacturers Association (NEMA) 5-15S or 6-20S standards. The outlet wall plate may define a pair of socket openings. The outlet wall plate may also define a pair of plug stabilizing features. The plug stabilizing feature may be formed integrally with the plate and the outlet wall plate may consist of a single piece of injection molded plastic.

The inner surface of the plate may define a plurality of structural ridges configured to increase rigidity and strength of the plate. The inner wall of the plug stabilizing feature may be substantially parallel to the outer wall of the plug stabilizing feature. A length of the inner wall of the plug stabilizing feature may be less than a length of the outer wall of the plug stabilizing feature.

The length of the inner wall of the plug stabilizing feature may be greater than or equal to a terminal pin length of an electrical plug configured to be received within the outlet socket. A distance from the socket terminals of the outlet socket to the top wall of the plug stabilizing feature may be greater than or equal to a length of terminal pins of an electrical plug configured to be received within the outlet socket.

The foregoing and other objects, features, and advantages of the invention will be apparent from the following detailed descriptions of embodiments of the invention the accompanying drawings of these embodiments.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Presented herein is a description an electrical outlet wall plate that includes a plug stabilizing feature that is configured to inhibit rotation of the terminal pins of an electrical plug connected to an electrical outlet surrounded by the outlet wall plate. The outlet wall plate is configured to installation over an electrical outlet. Such an electrical outlet may conform to a variety of standards. An electrical outlet used in North America may conform to the National Electrical Manufacturers Association (NEMA) 5-15S or 6-20S standards. Further, some electrical outlets may include ground fault circuit interruption (GFCI) protection. Those skilled in the art will immediately recognize that although the outlet wall plate depicted in the illustrate embodiments is configured for use with NEMA compliant electrical outlets, outlet wall plates with plug stabilizing features as shown herein may be manufactured for use with an electrical outlets conforming to other national standards, such as Europlug CCE 7/16, British Standard (BS) 1363, Australian/New Zealand Standard AS/NZS 3112, or Chinese PPCS-CCC technical standards.

Figure 5:
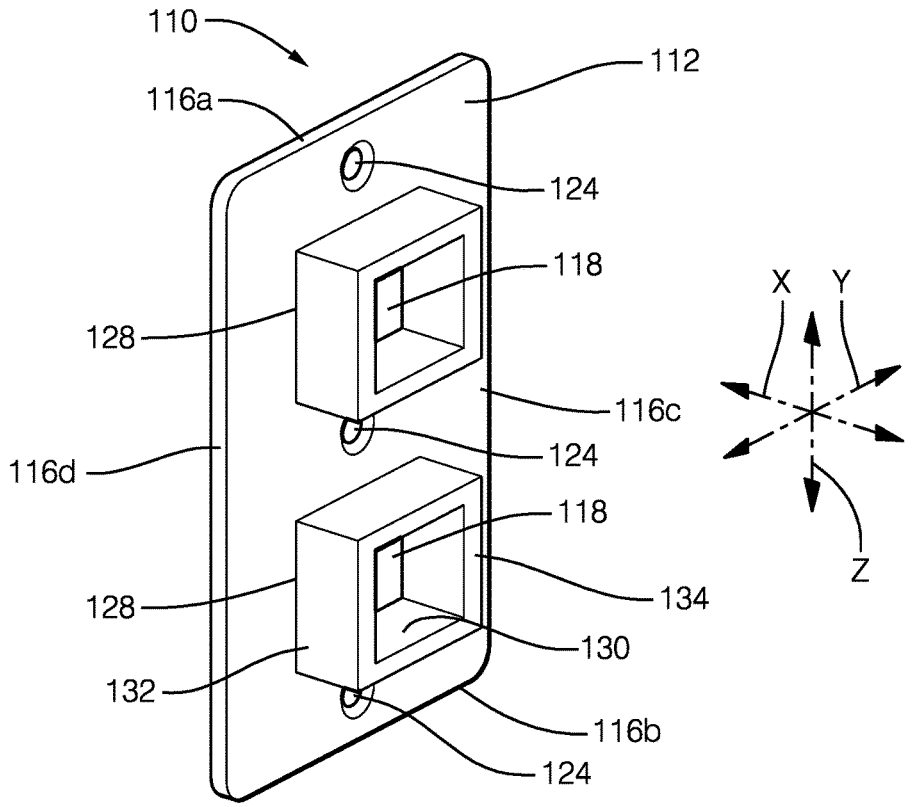
FIG. 5 is a perspective view of an outlet cover plate having plug stabilizing features according to a first embodiment.

FIG. 5 illustrates a non-limiting example of an electrical outlet wall plate 110, hereinafter referred to as a plate 110. The plate 110 has an outer surface 112, an inner surface 114 (not shown in FIG. 5 due to perspective), and a peripheral edge 116. The peripheral edge 116 of the illustrated plate 110 includes an upper edge 116*a*, a lower edge 116*b*, a right edge 116*c*, and a left edge 116*d*. The plate 110 defines one or more socket openings 118 that are configured to receive an electrical outlet socket 120 (see FIG. 6). The term "electrical outlet socket" as used herein refers to the portion of an electrical outlet 122 (see FIG. 6) into which the terminal pins of a mating electrical plug 138 (see FIG. 6) are inserted. The plate 110 in the example illustrated in FIG. 5 includes two socket openings 118. However, other embodiments of the plate 110 may include a single socket opening 118 or more than two socket openings 118. The socket openings 118 are is configured to receive an electrical outlet socket 120 conforming to NEMA 5-15S or 6-20S standards.

The plate 110 also defines one or more fastener openings 124 that are configured to receive a fastener (not shown) that is configured to secure the plate 110 to the electrical outlet 122. Examples of such fasteners may include screws, bolts, rivets, or the like. The plate 110 in the example illustrated in FIG. 5 includes three fastener openings 124. However, other embodiments of the plate 110 may include a single fastener opening as well as two or more fastener openings.

The plate 110 further includes a plug stabilizing feature 128 having an inner wall 130, an outer wall 132, and a top wall 134. The inner wall 130 comprises a top upper inner wall 130*a*, a lower inner wall 130*b*, a right inner wall 130*c*, and a left inner wall 130*d*. Likewise, the outer wall 132 comprises a top upper outer wall 132*a*, a lower outer wall 132*b*, a right outer wall 132*c*, and a left outer wall 132*d*. The plug stabilizing feature 128 projects from the outer surface 112 of the plate 110 and at least partially surrounds a perimeter of the socket opening 118. As shown in FIG. 5 the plug stabilizing feature 128 completely surrounds the perimeter of the socket opening 118. The example plate 110 illustrated in FIG. 5 defines a pair of plug stabilizing features 128 surrounding each of the socket openings 118. Other embodiments of the plate 110 may be envisioned in which a plug stabilizing feature 128 does not surround every socket opening 118 in the plate 110.

Figure 6:
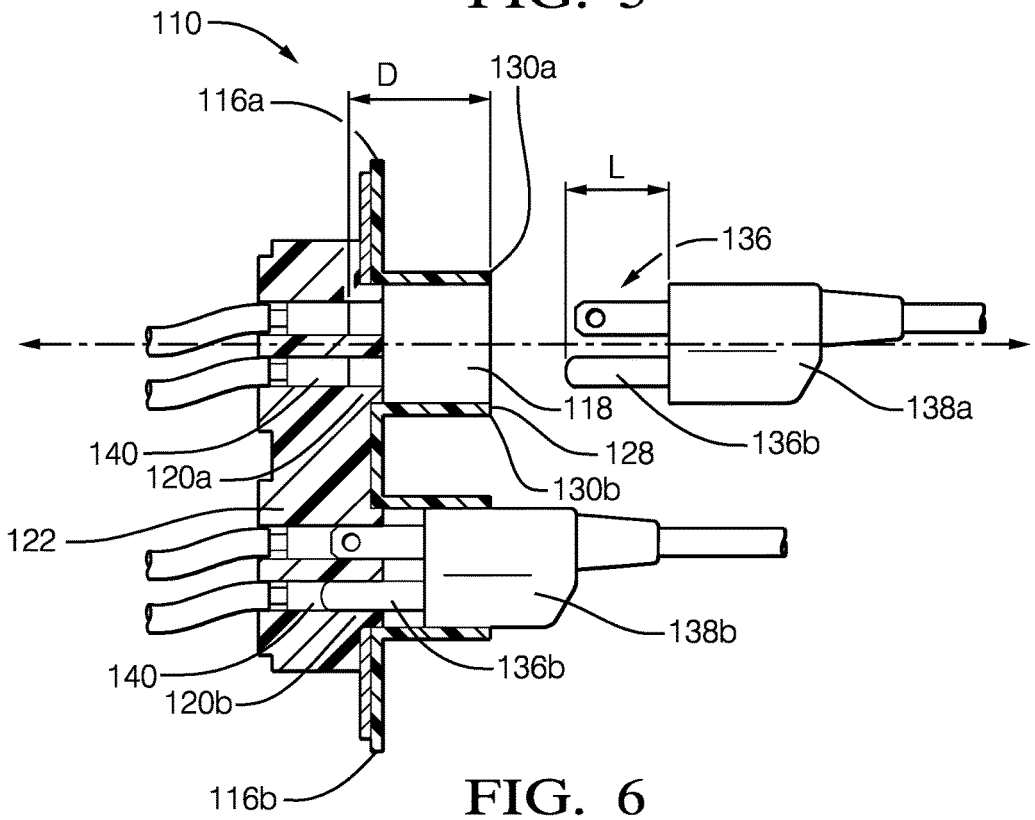
FIG. 6 is a side view of the outlet cover plate of FIG. 5 showing the relationship between the height of the walls of the plug stabilizing feature and a length of plug terminals according to the first embodiment.

As shown in FIG. 6, the outlet is configured so that the terminals 136 of the plug 138 are inserted along a longitudinal axis X. The inner walls 130-*a-d* of the plug stabilizing feature 128 are substantially parallel to the corresponding and opposing outer walls 132*a-d* and to the longitudinal axis X. The plug stabilizing feature 128 is preferably sized so that the inner wall 130 is nearly in intimate contact with the body of the plug 138 when the terminals 136 of the plug 138 are inserted in the socket 120, thereby inhibiting movement of the plug 138 in axes that are orthogonal to the longitudinal axis, such as the lateral and vertical axes Y, Z. Therefore, the inner walls 130*a-d* of the plug stabilizing feature 128 are closer to the socket opening 118 than the peripheral edges 116*a-d* of the plate 110.

As shown by the upper plug 138*a* and upper outlet socket 120*a* in FIG. 6, the distance D from a socket terminal 140 in the electrical outlet socket 120*a* to the top wall 134 of the plug stabilizing feature 128 is greater than or equal to a length L of the longest terminal 136*a* in the plug 138*a*, typically a ground pin. This relationship between the distance D and the length L should optimize stability of the plug 138 being held by the plug stabilizing feature 128 and the height of the inner and outer walls 130, 132 to provide adequate surface for the operator 142 to grip the plug 138. As shown in the lower plug 138*b* and lower outlet socket 120*b* in FIG. 6, the inner walls 130*a-d* of the plug stabilizing feature 128 are in contact with the body of the plug 138*b* when the longest terminal 138*b* begins to be inserted into the socket terminal 140, thereby guiding the plug 138 and aligning the plug terminals 136 with the socket terminals 140. In addition, because the inner walls 130*a-d* of the plug stabilizing feature 128 are in contact with the body of the plug 138 the plug terminals 136 are also protected from inadvertent contact by the operator 142 as the plug 138 is inserted into the outlet socket 120.

Figure 7:
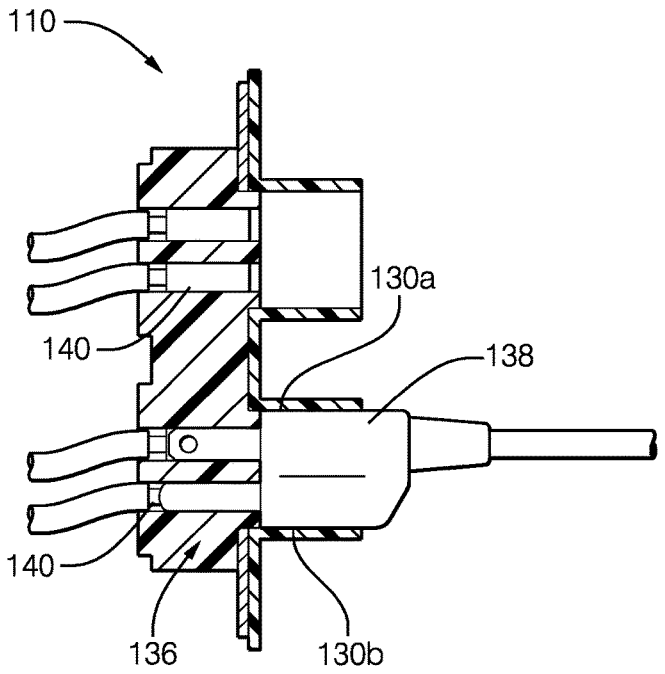
FIG. 7 is a side view of the outlet cover plate of FIG. 5 showing a plug fully inserted within the socket according to the first embodiment.

As illustrated in FIG. 7, when the plug terminals 136 are fully seated in the outlet socket terminals 140, the body of the plug 138 is disposed between the inner walls 130*a-d* of the plug stabilizing feature 128. The contact between the inner walls 130*a-d* and the body of the plug 138 inhibit motion of the body of the plug 138, and thereby the plug terminals 136 in the lateral and vertical axes Y, Z relative to the outlet socket 120.

Figure 8:
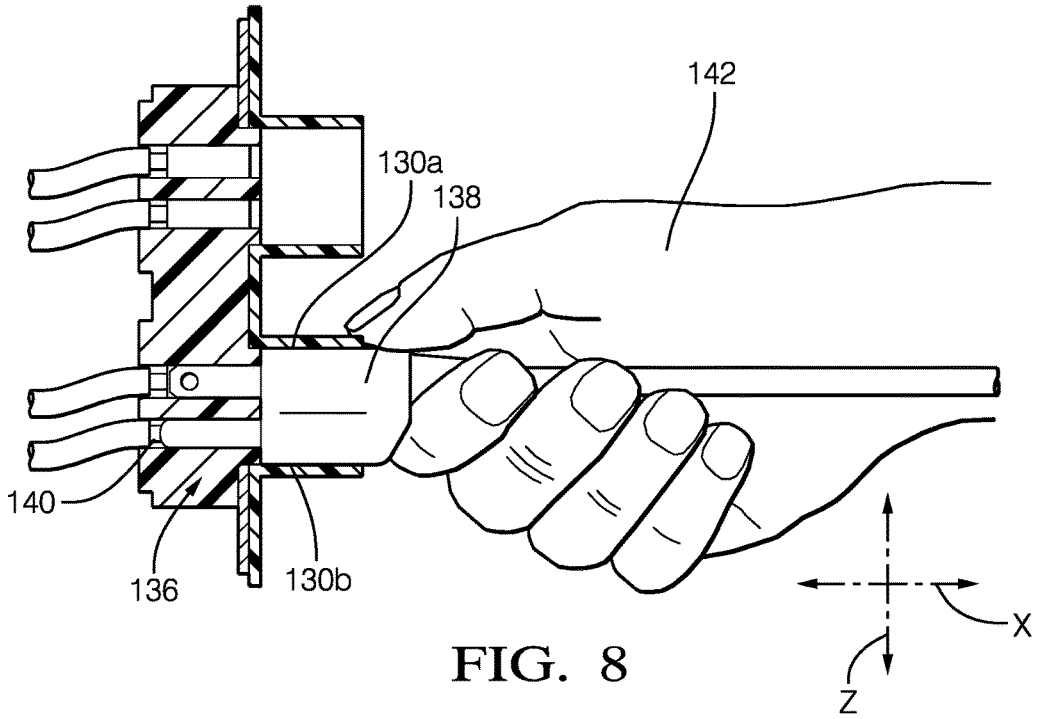
FIG. 8 of an operator properly removing an electrical plug from an electrical socket having the outlet cover plate of FIG. 5 according to the first embodiment.

As shown in FIG. 8, because the movement of the body of the plug 138 is retrained in the lateral axis Y and especially the vertical axis Z, the operator 142 is guided to properly remove the plug 138 from the outlet socket 120 along the longitudinal axis X, thereby reducing the risk of damage to the plug 138 and/or outlet socket 120. In addition, the terminal pins are also protected from inadvertent contact by the operator 142 as the plug 138 is inserted into the outlet socket 120 because the inner walls 130*a-d* of the plug stabilizing feature 128 are in contact with the body of the plug 138 as also shown in FIG. 8.

The plug stabilizing feature 128 in the illustrated example is formed integrally with the plate 110. The plate 110 and plug stabilizing feature 128 consist of a single piece of injection molded plastic. Materials suitable for forming the plate 110 are well known to those skilled in the art.

Embodiments may be envisioned in which the top surface of the plug stabilizing feature 128 is chamfered from the outer wall 132 toward the inner wall 130 so that a length of the inner wall 130 is less than a length of the outer wall 132. The chamfered top surface may serve to guide the body of the plug 138 into the plug stabilizing feature 128.

Figure 9:
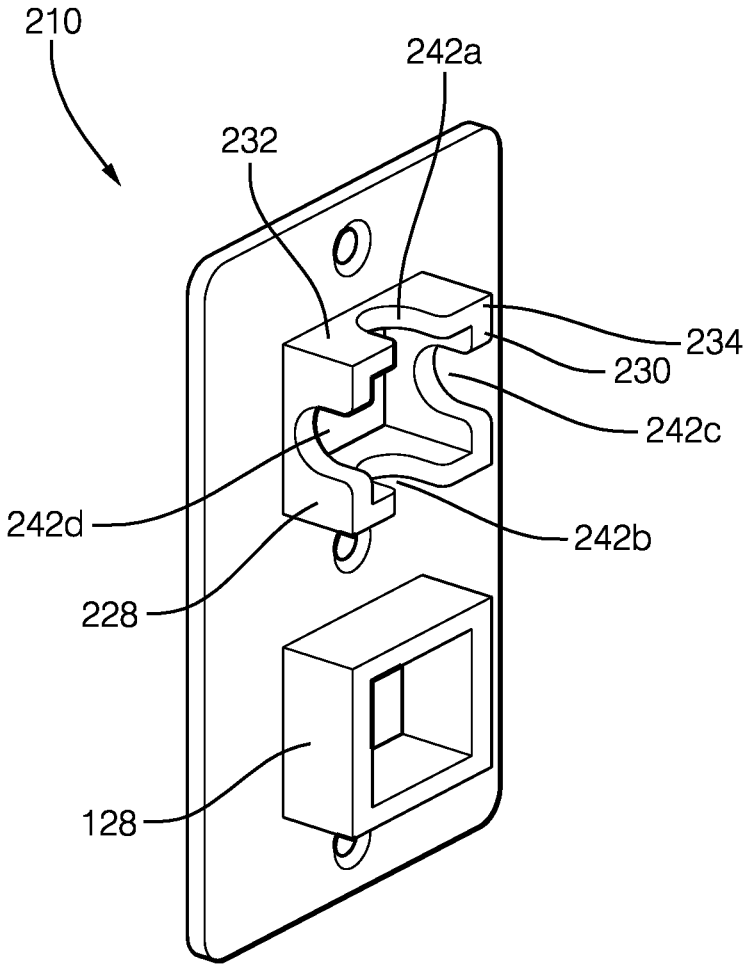
FIG. 9 is a perspective view of an outlet cover plate having plug stabilizing features according to a second embodiment.
Figure 10A:
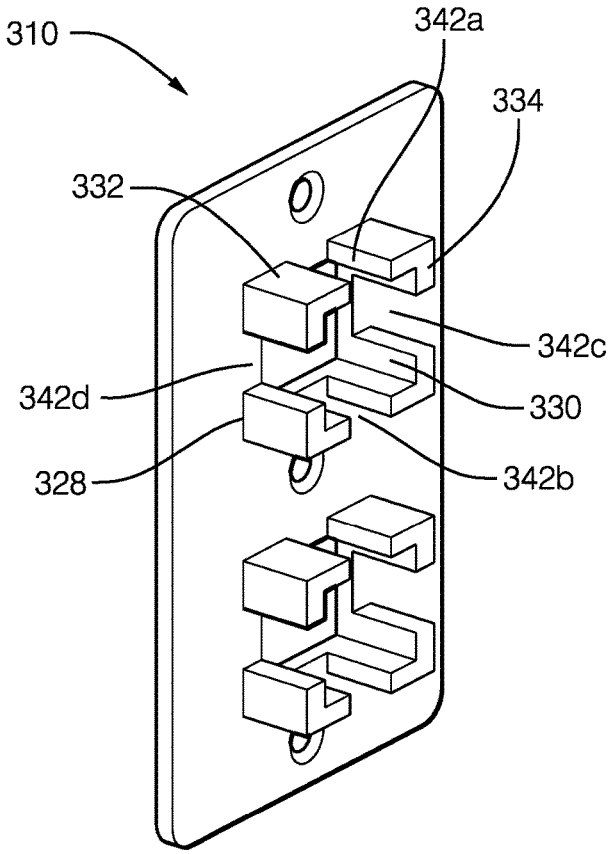
FIG. 10A is a perspective view of an outlet cover plate having plug stabilizing features according to a third embodiment.
Figure 10B:
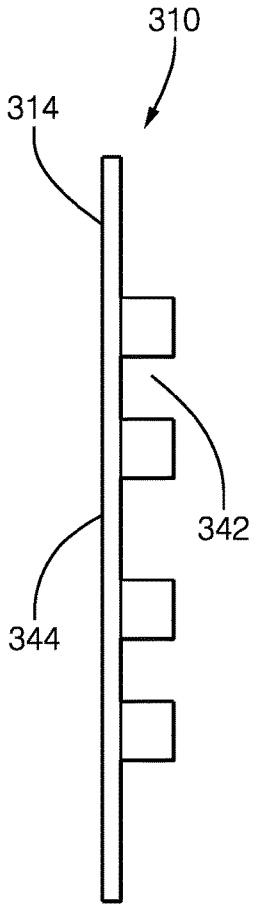
FIG. 10B is a side view of the outlet cover plate of FIG. 10A according to the third embodiment.

Other non-limiting examples of a plate 210, 310 are shown in FIGS. 9-10B. The last two digits of reference numbers of features shown in the embodiments of FIGS. 9-10B that are similar to features of plate 110 will match.

Figure 1:
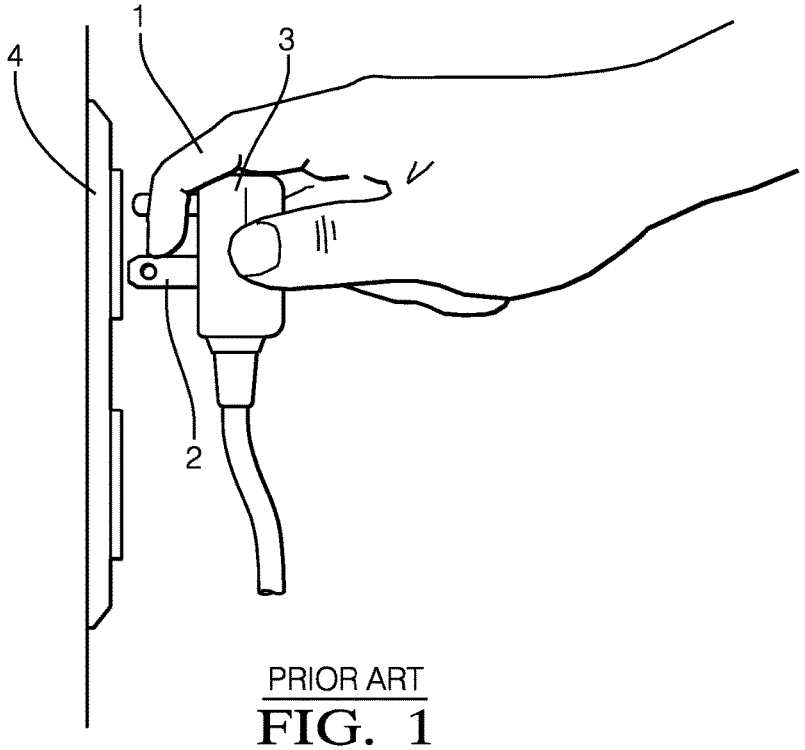
PRIOR ART FIG. 1
FIG. 1 is a side view of an operator inserting an electrical plug into an electrical socket having a cover plate according to the prior art.
Figure 2A:
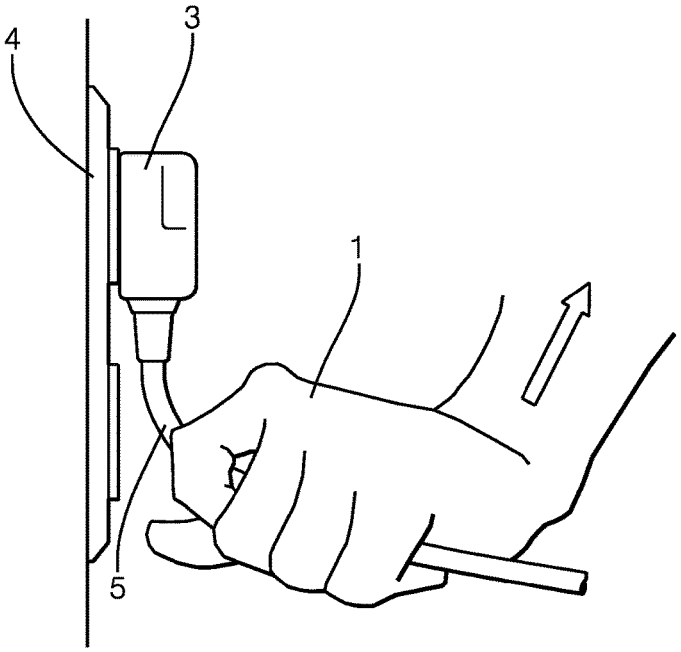
PRIOR ART FIG. 2A
FIG. 2A is a side view of an operator improperly removing an electrical plug from an electrical socket having an outlet cover plate according to the prior art.
Figure 2B:
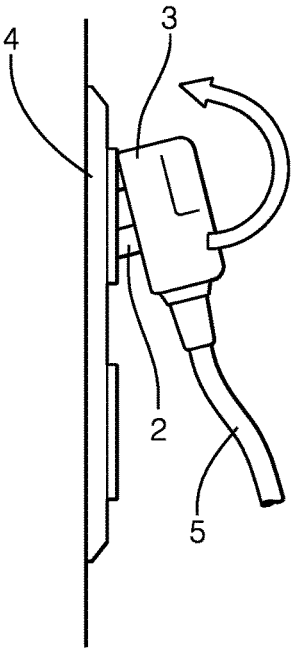
PRIOR ART FIG. 2B
FIG. 2B is a side view of rotation of a ninety degree electrical plug in an electrical socket having an outlet cover plate according to the prior art.

The plate 210 shown in FIG. 9 defines a slot 242 in the top wall 234 extending from the outer wall 232 to the inner wall 230. The slot 242 may be configured to accommodate the cord extending from the body of a ninety degree plug, an example of which is shown in FIG. 1. As shown in FIG. 9, the plug stabilizing features 228 define four slots 242*a-d* in the top wall 234 extending from the outer wall 232 to the inner wall 230 and are arranged in an ninety degree orientation from one another. These slots 242*a-d* may allow the plate 210 to accommodate plugs with various cable exit configuration. These slots 242*a-d* may further improve the ability to grip the plug 138 when removing the plug 138 from the socket 120. The slots 242*a-d* shown in FIG. 9 have a rounded end. The rounded ends of the slots 242*a-d* may offer ergonomic advantages while the operator 142 grips the plug 138.

The plate 310 illustrated in FIGS. 10A-10B defines a slot 342 in the top wall 334 extending from the outer wall 332 to the inner wall 330. The slot 342 also may be configured to accommodate the cord extending from the body of a ninety degree plug, an example of which is shown in FIG. 1. As shown in FIG. 10A, the plug stabilizing features 328 define four slots 342*a-d* in the top wall 334 extending from the outer wall 332 to the inner wall 330 and are arranged in an ninety degree orientation from one another. These slots 342 may allow the plate 310 to accommodate plugs with various cable exit configuration. The plug stabilizing features 328 may adequately support the plug 138 while also reducing the amount of material used to form the plate 310 compared to the plate 110 shown in FIG. 5 wherein the plug stabilizing feature 128 completely surrounds the socket openings 118. The slots 342*a-d* have a flat end and extend from the top wall 334 to the outer surface 312 of the plate 310.

As illustrated in FIG. 10B, the inner surface 314 of the plate 310 may also include one or more structural ridges 344 configured to increase strength and rigidity of the plate 310. Due to the strain placed on the plate 310 by forces exerted by a plug 138 that is secured by one of the, the plate 310 may at times be bent at various angles. To ensure that the plate 310 does not break or otherwise become malformed, the structural ridges 344 may increase rigidity and strength of the plate 310. These ridges may also be incorporated in plates 110 and 210.

Figure 3:
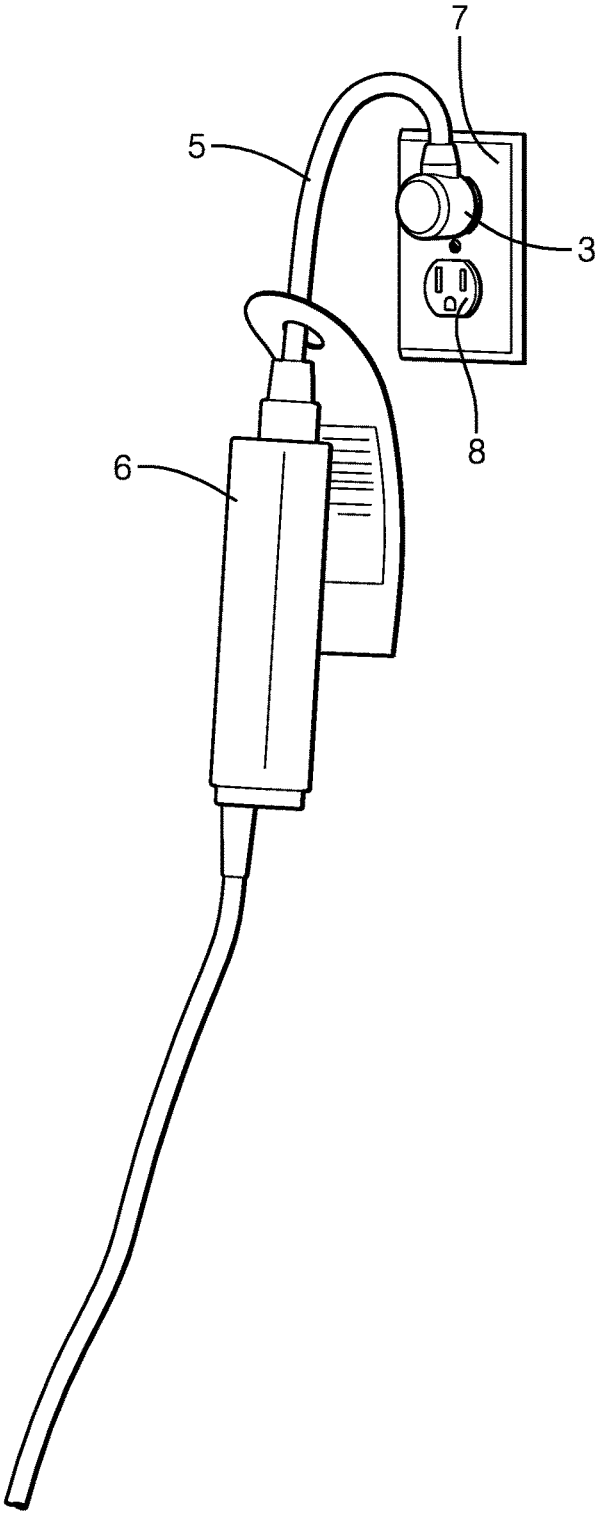
PRIOR ART FIG. 3
FIG. 3 is a perspective view of an electrical device hanging from an electrical plug in an electrical socket having an outlet cover plate according to the prior art.
Figure 4:
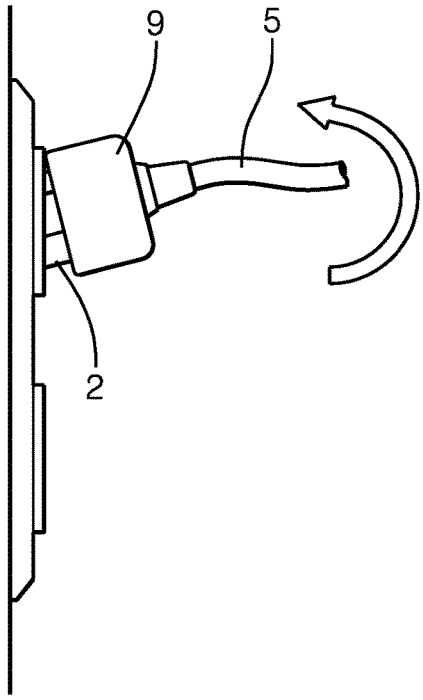
PRIOR ART FIG. 4
FIG. 4 is a side view of rotation of a straight electrical plug in an electrical socket having an outlet cover plate according to the prior art.

Accordingly, an electrical outlet wall plate 110, 210, 310 having plug stabilizing features 128, 228, 328 is provided. The plate 110, 210, 310 provides the benefit of limiting lateral and vertical movement of the plug terminals 136 in the socket 120, thereby preventing damage to the plug 138 and/or socket 120 that may be caused by an operator 142 improperly removing the plug 138 from the socket 120 as shown in FIG. 1 or hanging an electrical device from the socket 120 by the cord as shown in FIG. 3. The plug stabilizing feature 128, 228, 328 also protects the operator 142 from inadvertent contact with the plug terminals 136 as the plug 138 is inserted into the socket 120.

While this invention has been described in terms of the preferred embodiments thereof, it is not intended to be so limited, but rather only to the extent set forth in the claims that follow. Moreover, the use of the terms first, second, upper, lower, etc. does not denote any order of importance, location, or orientation, but rather the terms first, second, etc. are used to distinguish one element from another. Furthermore, the use of the terms a, an, etc. do not denote a limitation of quantity, but rather denote the presence of at least one of the referenced items.

We claim:

1. An electrical outlet wall plate, comprising:

a plate having an outer surface, an inner surface, and a peripheral edge defining a socket opening configured to receive an electrical outlet socket; and a plug stabilizing feature having an inner wall, an outer wall, and a top wall, said plug stabilizing feature projecting from the outer surface of the plate and completely surrounding a perimeter of the socket opening, wherein the plug stabilizing feature is closer to the socket opening than the peripheral edge of the plate.

2. The outlet wall plate according to claim 1, wherein the plate further defines a fastener opening configured to receive a fastener configured to secure the outlet wall plate to the outlet socket.

3. The outlet wall plate according to claim 1, wherein the plug stabilizing feature defines a slot in the top wall extending from the outer wall to the inner wall.

4. The outlet wall plate according to claim 3, wherein the plug stabilizing feature defines four slots in the top wall extending from the outer wall to the inner wall and arranged in an ninety degree orientation from one another.

5. The outlet wall plate according to claim 1, wherein the socket opening is configured to receive the outlet socket when conforming to NEMA 5-15S or 6-20S standards.

6. The outlet wall plate according to claim 1, wherein the plug stabilizing feature is formed integrally with the plate.

7. The outlet wall plate according to claim 1, consisting of a single piece of injection molded plastic.

8. The outlet wall plate according to claim 1, wherein a distance from a socket terminal of the outlet socket to the top wall of the plug stabilizing feature is greater than or equal to a length of terminal pins of an electrical plug configured to be received within the outlet socket.

9. The outlet wall plate according to claim 1, wherein the plug stabilizing feature is sized such that the inner wall is nearly in intimate contact with a body of the electrical plug when terminals of the plug are inserted in the electrical outlet socket, thereby inhibiting movement of the electrical plug in axes that are orthogonal to the longitudinal axis.

10. The outlet wall plate according to claim 1, wherein the outlet is configured so that an electrical plug are inserted into the outlet along a longitudinal axis and wherein the inner wall of the plug stabilizing feature is substantially parallel to the longitudinal axis.

* * * * *